US011280077B2

(12) United States Patent
Kochavi

(10) Patent No.: US 11,280,077 B2
(45) Date of Patent: Mar. 22, 2022

(54) WATER-PRESSURE—POWERED TOILET FLUSHING MECHANISM

(71) Applicant: Ofer Kochavi, Tzurit (IL)

(72) Inventor: Ofer Kochavi, Tzurit (IL)

(73) Assignee: Ofer Kochavi, Tzurit (IL)

( * ) Notice: Subject to any disclaimer, the term of this patent is extended or adjusted under 35 U.S.C. 154(b) by 85 days.

(21) Appl. No.: 16/708,468

(22) Filed: Dec. 10, 2019

(65) Prior Publication Data

US 2020/0190782 A1 Jun. 18, 2020

Related U.S. Application Data

(60) Provisional application No. 62/781,287, filed on Dec. 18, 2018.

(51) Int. Cl.
*E03D 5/01* (2006.01)
*E03D 1/28* (2006.01)

(52) U.S. Cl.
CPC ..... *E03D 5/01* (2013.01); *E03D 1/286* (2013.01)

(58) Field of Classification Search
CPC ..... E03D 1/286; E03D 5/01
USPC ..... 4/331, 332
See application file for complete search history.

(56) References Cited

U.S. PATENT DOCUMENTS 8,702,387 B2 * 4/2014 Gillette ..... F04D 29/548 415/221
9,869,079 B2 * 1/2018 Boodaghians ..... E03F 1/006
2010/0212696 A1 * 8/2010 Shirai ..... E03D 11/08 134/22.1
2018/0119402 A1 * 5/2018 Feldman ..... E03D 5/01
(Continued)

FOREIGN PATENT DOCUMENTS

CN 204139277 U 2/2015
CN 106759757 A 5/2017
DE 8707848 U1 10/1987
(Continued)

OTHER PUBLICATIONS

European Search Report issued in European Patent Application No. 19215246 dated Apr. 23, 2020.
(Continued)

*Primary Examiner* — Christine J Skubinna

(74) *Attorney, Agent, or Firm* — Marshall, Gerstein & Borun LLP

(57) ABSTRACT

A flush toilet resting over a floor and comprising: a toilet bowl; a first water conduit comprising a first conduit—first end and a first conduit—second end; a second water conduit, comprising a second conduit—first end and a second conduit—second end, and; at least one water pump, the at least one pump water-powered and not electrically powered; wherein:

the first conduit—first end is operationally connectable to an external water pipe comprising pressurized water;

the first conduit—second end is positioned to allow providing the pressurized water to the water pump;

the second conduit—first end is operationally connected to receive water from the water pump;

wherein the water pump is positioned proximal to the bowl and between the bowl and the floor, and wherein the toilet is configured such that action of water on the at least one pump allows the flush of at least 6 liters per second.

17 Claims, 10 Drawing Sheets

(56) References Cited

U.S. PATENT DOCUMENTS

2020/0095755 A1* 3/2020 Tran ..... E03D 9/005

FOREIGN PATENT DOCUMENTS

| | | | |
|---|---|---|---|
| DE | 10306661 | A1 | 3/2005 |
| KR | 20180039334 | A | 4/2019 |

OTHER PUBLICATIONS

Pelton Wheel Wikipedia entry (Dec. 2, 2019) https://en.wikipedia.org/w/index.php?title=Pelton_wheel&oldid=928981603.
Kris De Decker (Sep. 9, 2013) Power From the Tap: Water Motors http://www.lowtechmagazine.com/2013/09/power-from-the-tap-water-motors.html.

* cited by examiner

WATER-PRESSURE—POWERED TOILET FLUSHING MECHANISM

CROSS REFERENCE TO RELATED APPLICATIONS:

This application claims the benefit of US provisional application 62/781287 filed on Dec. 18, 2018 by the same inventor according to 35 U.S.C. § 119 (e); said provisional application is fully incorporated herein by reference.

BACKGROUND

One of the most common types of flush toilet has a water tank that is elevated above the toilet bowl. The water tank typically occupies space that might be useful to have available for other purposes. The relative elevation of the water tank with respect to the toilet bowl gives a difference in the potential energy density of the water in the tank as compared to the potential energy density of the water at the height of the bowl, thus creating water pressure at the height of the toilet bowl. This water pressure provides the energy and power to produce an effective flush. Notice that the potential energy of the water in the elevated tank comes entirely from the household water pressure.

However, if household water pipes were connected in the simplest way directly to the toilet bowl, not by an indirect path through an elevated tank, the flush is generally much weaker, and for typical household piping, insufficient.

Because of conservation of energy and mass, and the fact that in the indirect path (first to an elevated tank from there to the toilet bowl) there are more opportunities for the water to lose energy, one might expect pipes directly connected to the toilet bowl to give a stronger flush, that is, with more energy and momentum.

The two paragraphs above pose a paradox. The paradox is resolved by the realization that (1) when water flows quickly in the piping upstream of the toilet, energy is lost due to, for example, friction between fast-flowing water and the pipes, and turbulence created by fast-flowing water in bends in the pipes; and (2) the narrowness of household pipes means that without a tank the water needed to flush has a long length to travel in the interim between the command to flush and the time after which the flush should be completed.

Let us give quantitative values to the demands of a toilet and the standard capabilities of household water pipes. In a direct path through household water pipes (not via an elevated tank), the distance from the initial position of the flushing water in the household pipes to the toilet bowl may be relatively long. A standard flush is eight (8) litres of water in one second. Eight (8) litres occupies more than 16 meters of 25 mm diameter pipe, or more than 63 meters of a 12.5 mm diameter pipe. Those distances are much longer than the distance between water tank and toilet bowl in standard toilets with elevated tanks, which means that, by comparison, the water must move more quickly to create an adequate flush. The long distances may also mean that the piping may need to bend to fit in a given space; these bends in the piping cause additional energy losses in the flowing water.

Let us examine the dynamics Standard minimum water pressures are roughly 1 or 2 atmospheres greater than the air pressure; typical and desirable water pressures are about 4 or 5 atmospheres. Occasionally water pressure may be up to 8 atmospheres. The damage threshold of typical household water pipes may be approximately 10 atmospheres.

As an example, let us assume: A device having a relatively low water pressure of 1 atmosphere; 12.5 mm diameter pipes; a pump that is 100% efficient, that there is no friction in the pipes; and the water tank is at the same height as the inlet to the toilet relative to the horizontal floor upon which the toilet bowl rests. We'll do the calculations using bars rather than atmospheres; one (1) atmosphere is equal to 1.013 bars. The force available from the pipe is $$\begin{aligned} F &= \text{Pressure} \times \text{area} \\ &= (1\ \text{bar}) \times \left[\pi(12.5\ \text{mm}/2)^2\right] \\ &= (10^5\ \text{N/m}^2)(\pi 6.25^2 10^{-6}\ \text{m}^2) \\ &= 12\ \text{N} \\ &= 12\ \text{kg m/s}^2 \end{aligned}$$

A standard flush is 8 litres in 1 second. 8 litres weighs 8 kg. The rate of acceleration of that weight of water is $$\begin{aligned} a &= \text{force}/\text{mass} \\ &= (12\ \text{kg m/s}^2)(8\ \text{kg}) \\ &= 1.5\ \text{m/s}^2 \end{aligned}$$

If the water starts from zero velocity, that acceleration will let the water move by $$\begin{aligned} (1/2)at^2 &= (1/2)(1.5\ \text{m/s}^2)s^2 \\ &= 0.75\ \text{m} \\ &= 75\ \text{cm} \end{aligned}$$

in the flush time of one second.

The length 75 centimetres is not nearly enough to move a sufficient volume of water in 12.5 mm diameter pipes, in which the volume of water in a flush occupies 63 meters of the pipe, from the pipes to the toilet bowl. Even a water pressure of 8 atmospheres or 10 atmospheres, which is close to the limit that typical household pipes can withstand, with 12.5 mm pipes, is insufficient to create a standard flush of 8 litres in a second. In pipes with a diameter of 25 mm, where 8 litres of water occupies 16 meters of pipe, the minimum standard water pressure is an order of magnitude (that is, roughly a factor of 10) too small to provide an adequate flush, and the high end of realistic household water pressures, 8 or 10 atmospheres, is just on the margin of enough pressure for an adequate flush.

Pump inefficiencies and friction can be expected to reduce the flow rate by a few tens of percent. If the water tank is below the inlet to the toilet, the flow could be significantly slowed by the need to overcome gravity.

The above calculations show that standard household water systems cannot create a sufficient flush using the simplest direct connection between the household water pipes and the toilet bowl. (The same calculations also point to what is possible, even if not currently obtained.)

Different configurations are necessary to produce a sufficient flush. An elevated water tank close to the toilet bowl (that is, the most common household toilet) is a configuration for bringing the water closer to the toilet bowl in preparation for a flush and for storing and releasing some of the energy from the pressure of the water in the household water supply. A disadvantage of this is that the position of the elevated water may be obtrusive and space-consuming.

Another configuration has the household water pipes go directly to the toilet bowl and has electric pump/s in the water pipes upstream of the toilet bowl to increase the water pressure and therefore the acceleration and velocity of the water, so that a sufficiently large volume of water flushes in the required time. The disadvantage of this is that connecting to electricity adds complications to the configuration.

SUMMARY

According to one aspect a device is provided which is a flush toilet. The water for the flush is drawn from a tank. The water tank is not necessarily elevated above the toilet, and does not rely solely on the potential energy due to the elevation and the pressure created by the elevation to force the flushing water into a toilet bowl. The water tank is positioned so that the water in a flush has a shorter path from the water tank to the toilet bowl than the flushing water's path from water pipes, without a water tank, to the toilet bowl. When a valve from an input water source (which is pressurized) is opened, water is propelled from the tank to the toilet bowl by a pump. The pump is driven by mechanical power (generally not by an electric motor), and that mechanical power is harvested from the water pressure of the external water pipes. The flushing water in the tank is replenished from the same external water supply.

Compared to simply opening a spigot from the external water pipes and having the water empty from the pipes into the toilet bowl, which tends to give an insufficient flush, this device's relatively short water path and indirect power transfer reduces energy dissipation and can therefore give a sufficiently strong flush. Because the water tank need not be as elevated as in conventional flush toilets, the tank may be located in a more advantageous position, such as behind, beside, or underneath the toilet bowl, which may save much space and optionally make the toilet more visually pleasing, being without an overhead tank and pipe.

According to one aspect a flush toilet is provided comprising: a toilet bowl;

a first water conduit comprising a first conduit—first end and a first conduit—second end;

a second water conduit, comprising a second conduit—first end and a second conduit—second end, and;

at least one water pump water-powered and not electrically powered; wherein:

the first conduit—first end is operationally connectable to an external water pipe comprising pressurized water;

the first conduit—second end is positioned to allow providing the pressurized water to the water pump;

the second conduit—first end is operationally connected to receive water from the water pump;

wherein the water pump is positioned proximal to the bowl and between the bowl and a floor, and wherein the toilet is configured such that action of water on the at least one pump allows the flush of at least 6 liters per second.

Some embodiments further comprise at least one water-driven turbine not electrically powered;

the toilet configured to allow water going through the first conduit to drive the at least one water-driven turbine;

the at least one water-driven turbine operationally connected to the at least one water pump so that mechanical power from the at least one water-driven turbine can drive the at least one water pump.

In some embodiments the at least one water-driven turbine is selected from the list consisting of:

an impulse turbine, a reaction turbine, and combinations thereof.

In some embodiments the at least one water pump is independently chosen from the following list:

a positive displacement pump, a reciprocating pump, a rotary pump, a rotodynamic pump, a centrifugal pump, a mixed flow pump, a radial pump, and combinations thereof.

In some embodiments a powertrain defines an operational connection from the at least one fluid-driven turbine to the at least one pump, and wherein the powertrain comprises a plurality of interconnected items selected from the following list:

gears, wires with torsional rigidity, rods with torsional rigidity, chains, inelastic belts, and inelastic wires.

In some embodiments action of water on the at least one pump allows the flush of at least 8 liters per second.

Some embodiments further comprise a water tank, and the bowl comprises a stem, and the tank at least partially surrounds or partially wraps the bowl's stem.

Some embodiments further comprise a water tank, and a permeable partition between the turbine and the at least one pump, the toilet configured to allow preventing vorticity, turbulence, or other movements of the water in the tank from degrading the performance of the at lesst one pump by the turbine or of the turbine by the pump.

In some embodiments the at least one turbine and the at least one pump are both immersed in water and and both churn the water in similar ways.

Some embodiments comprise units each including one turbine of the at least one turbine and one pump of the at least one pump.

In some embodiments the at least one pump is primable by feeding water therein before the flushing time.

Some embodiments further comprise a first valve, wherein while the pump is being emptied, water is prevented from entering the pump by closing the valve, thereby preventing back-pressure on the pump.

In some embodiments the second conduit comprises a second, typically normally closed (NC) valve, the toilet configured to allow while refilling the at least one pump, the NC valve to be closed so as to allow resumption of build up of pressure in the at least one pump.

In some embodiments the second conduit comprises a second, typically normally closed (NC) valve, the toilet configured to allow while refilling the at least one pump, the NC valve to remain open for a while to allow a continued, weaker flush for the while.

Some embodiments are further configured to allow controlling the weaker flush to be prolonged or shortened.

In some embodiments the first conduit comprises a float and a main valve controlled by the float, the toilet configured to allow the main valve to close when level water in the tank reaches the float, thereby keeping the at least one turbine above the level of the water in the tank.

In some embodiments the second conduit comprises one or more check valves, capable of preventing waste from reaching the at least one pump.

Some embodiments further comprise a moisture trap.

This summary is provided to introduce a selection of concepts in a simplified form that are further described below in the Brief Description of the Figures and the Detailed Description. This summary is not intended to identify key features or essential features of the claimed subject matter, nor is it intended to be used to limit the scope of the claimed subject matter.

BRIEF DESCRIPTION OF THE FIGURES

The figures illustrate generally, by way of example, but not by way of limitation, various embodiments discussed in the present document.

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

The number of elements shown in the Figures should by no means be construed as limiting and is for illustrative purposes only.

Figure 1:
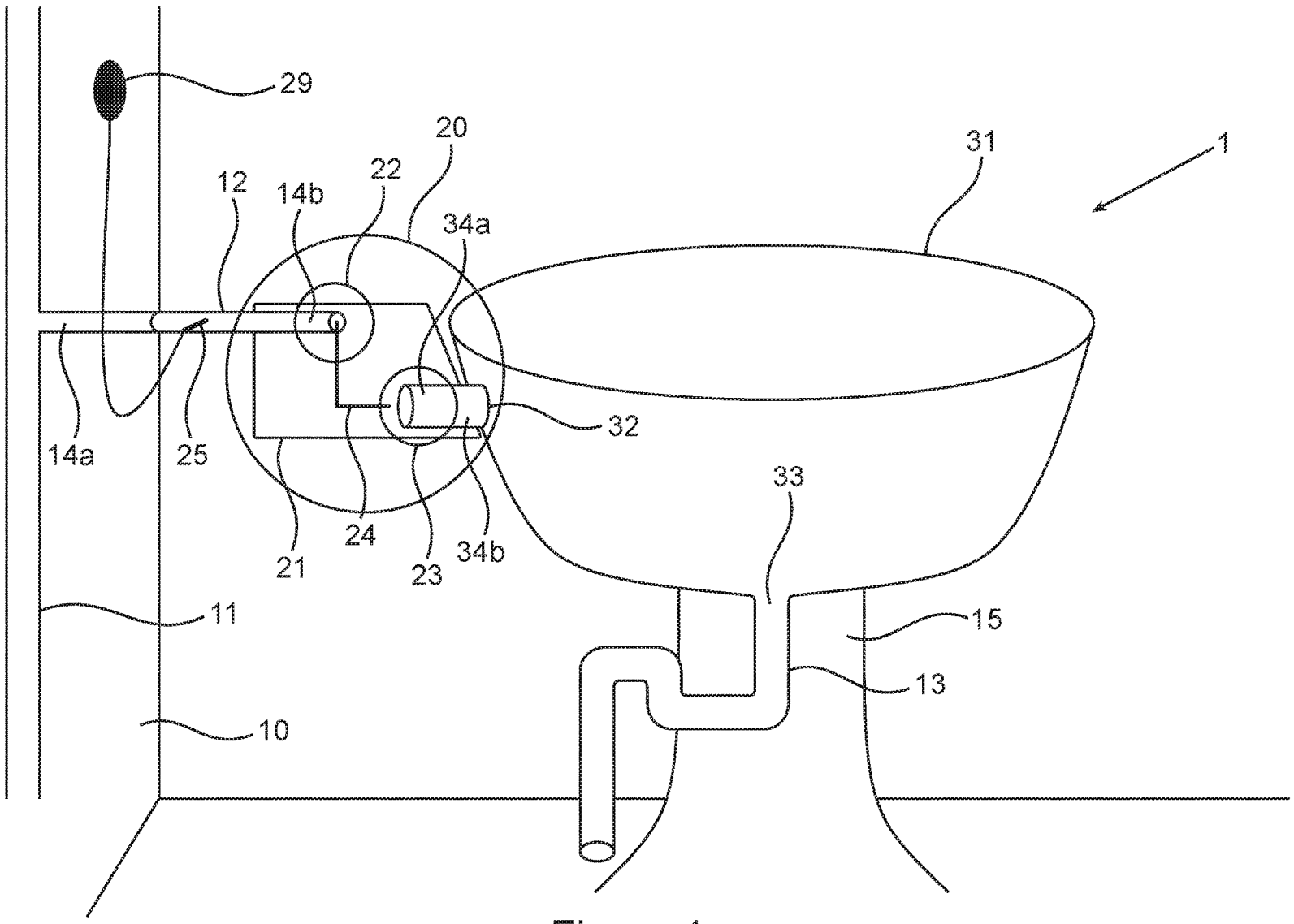

FIG. 1 shows a schematic drawing of a toilet embodiment in a sectional side-view wherein a water-driven turbine is positioned in a first conduit and a separate water pump is driven by the turbine and is positioned in a second conduit.

Figure 2A:
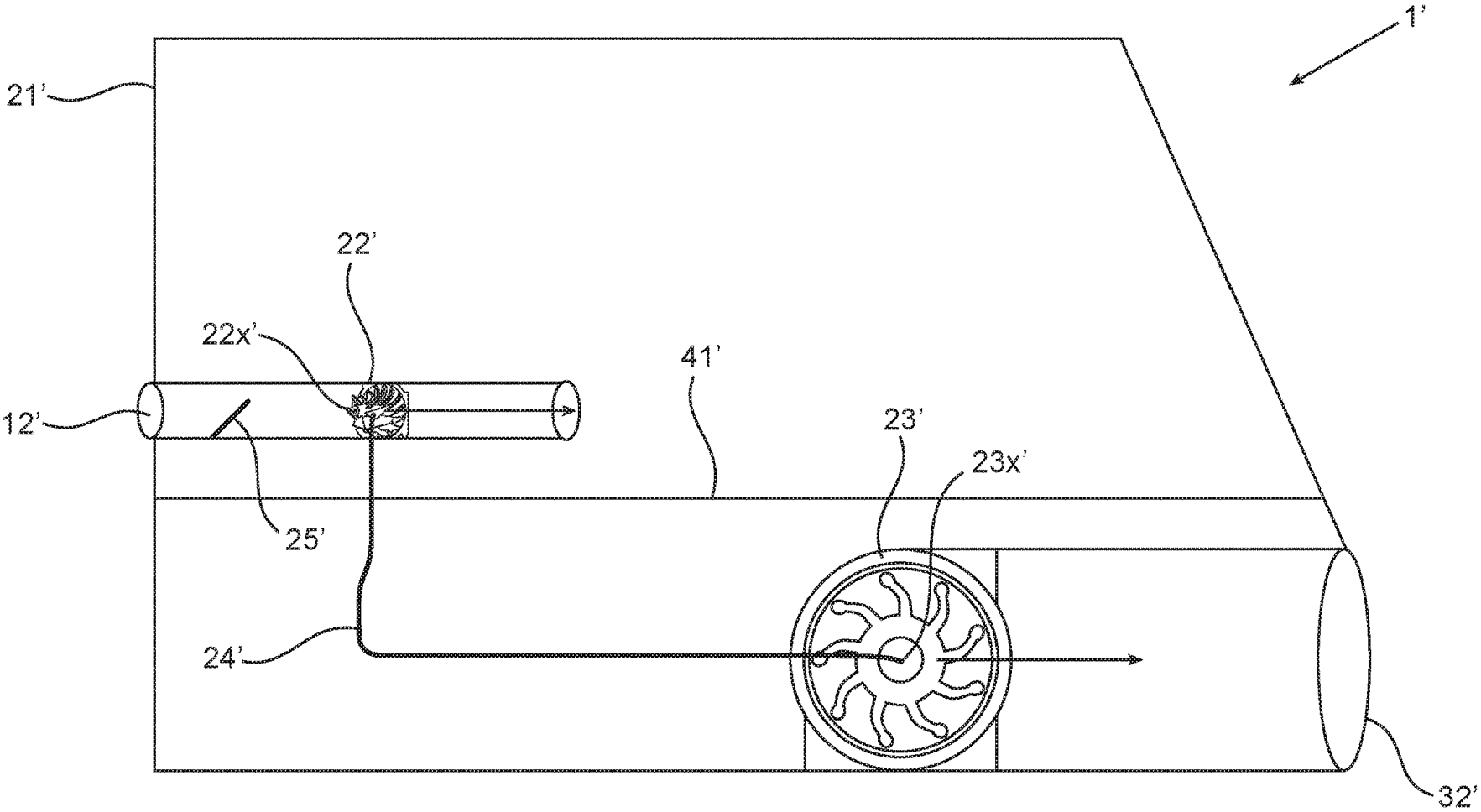

FIG. 2*a* shows in a sectional side-view a schematic drawing of an embodiment of a toilet similar to the toilet illustrated in FIG. 1.

Figure 2B:
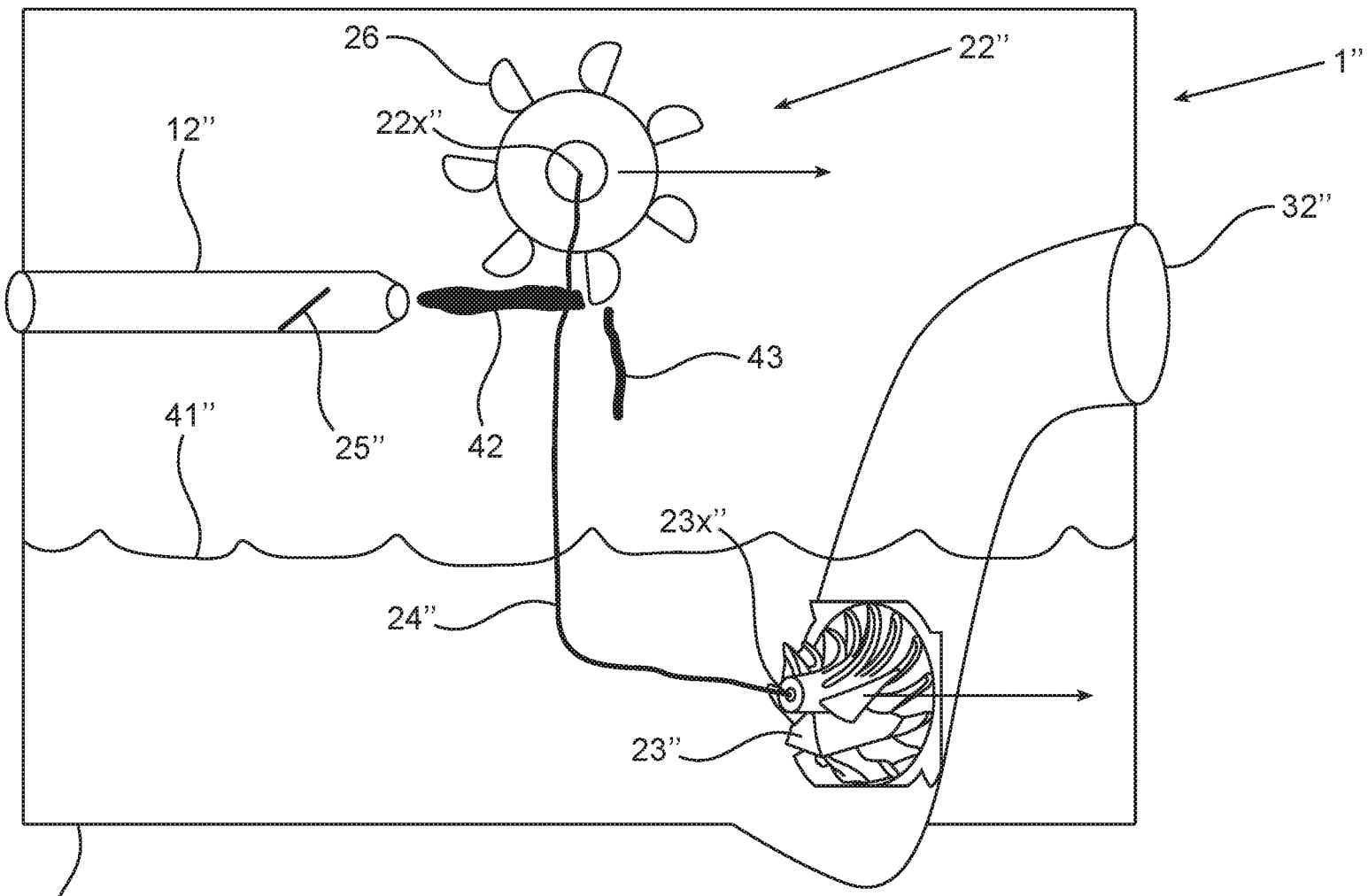

FIG. 2*b* shows in a sectional side-view another schematic drawing of another toilet embodiment similar to the toilet illustrated in FIG. 1.

Figure 3A:
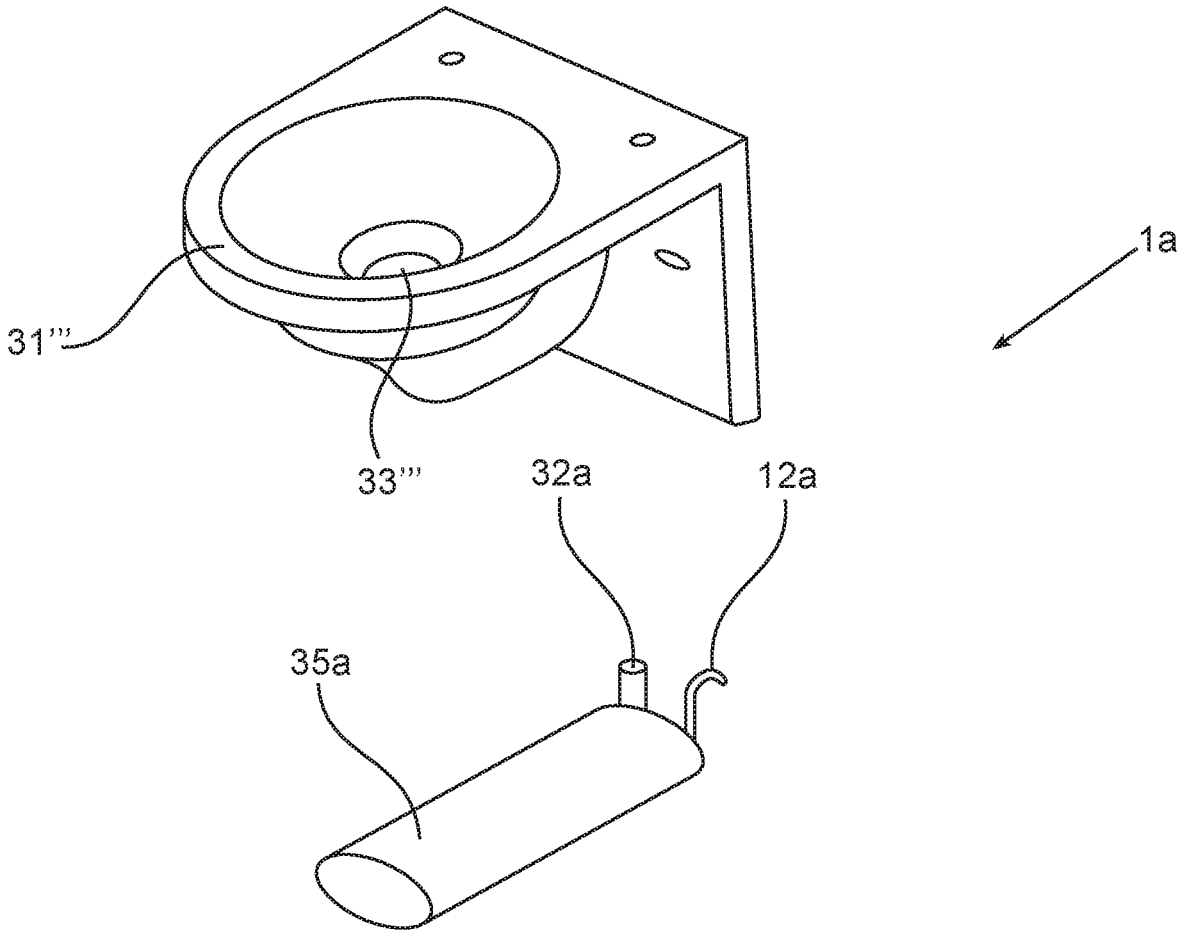

FIG. 3*a* shows an external, perspective view of an embodiment of a toilet, in which a water turbine-pump cartridge is designed to be located between the toilet bowl and the floor. To provide a clear view of the water turbine-pump cartridge, the water tank is not shown.

Figure 3B:
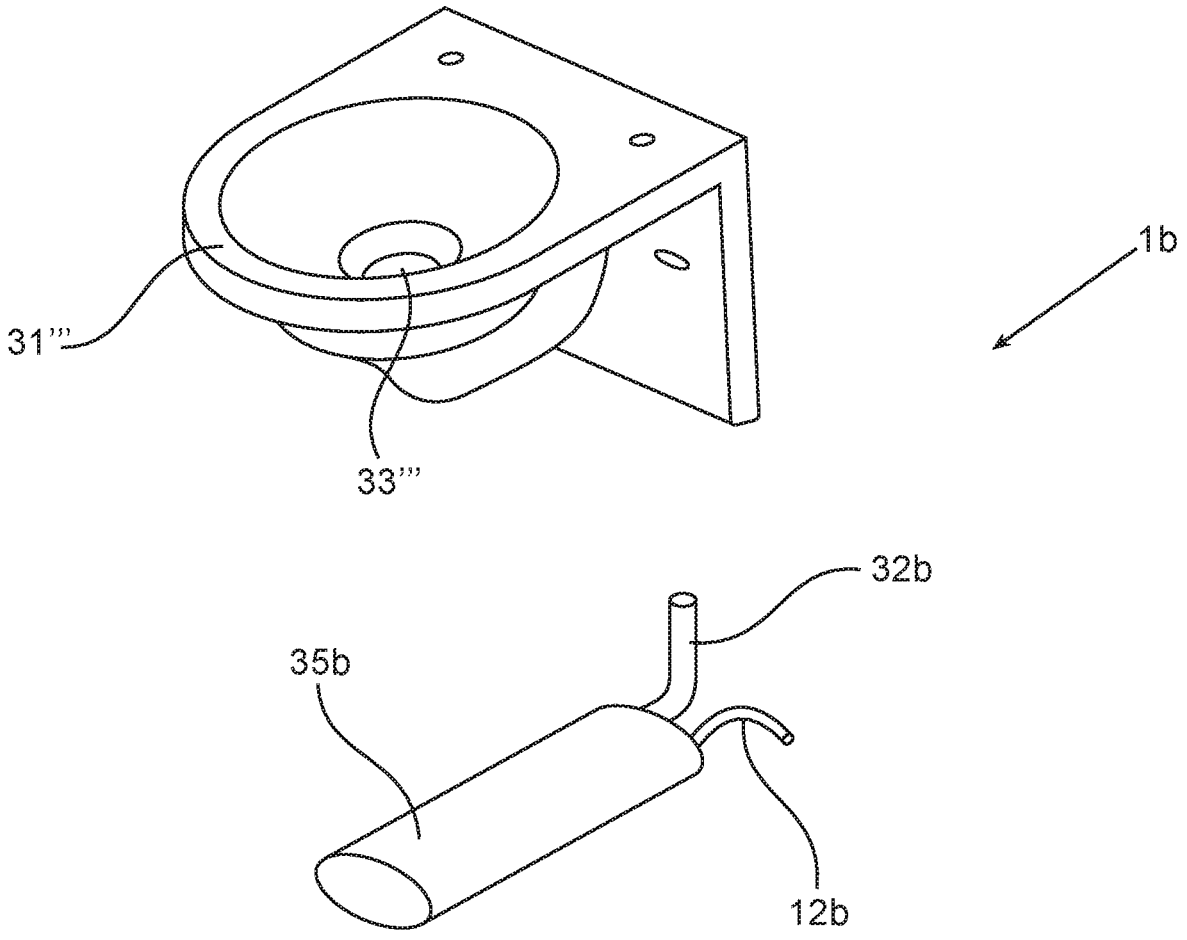

FIG. 3*b* shows an external perspective view of another embodiment of a toilet similar to the embodiment shown in FIG. 3*a;*

Figure 3C:
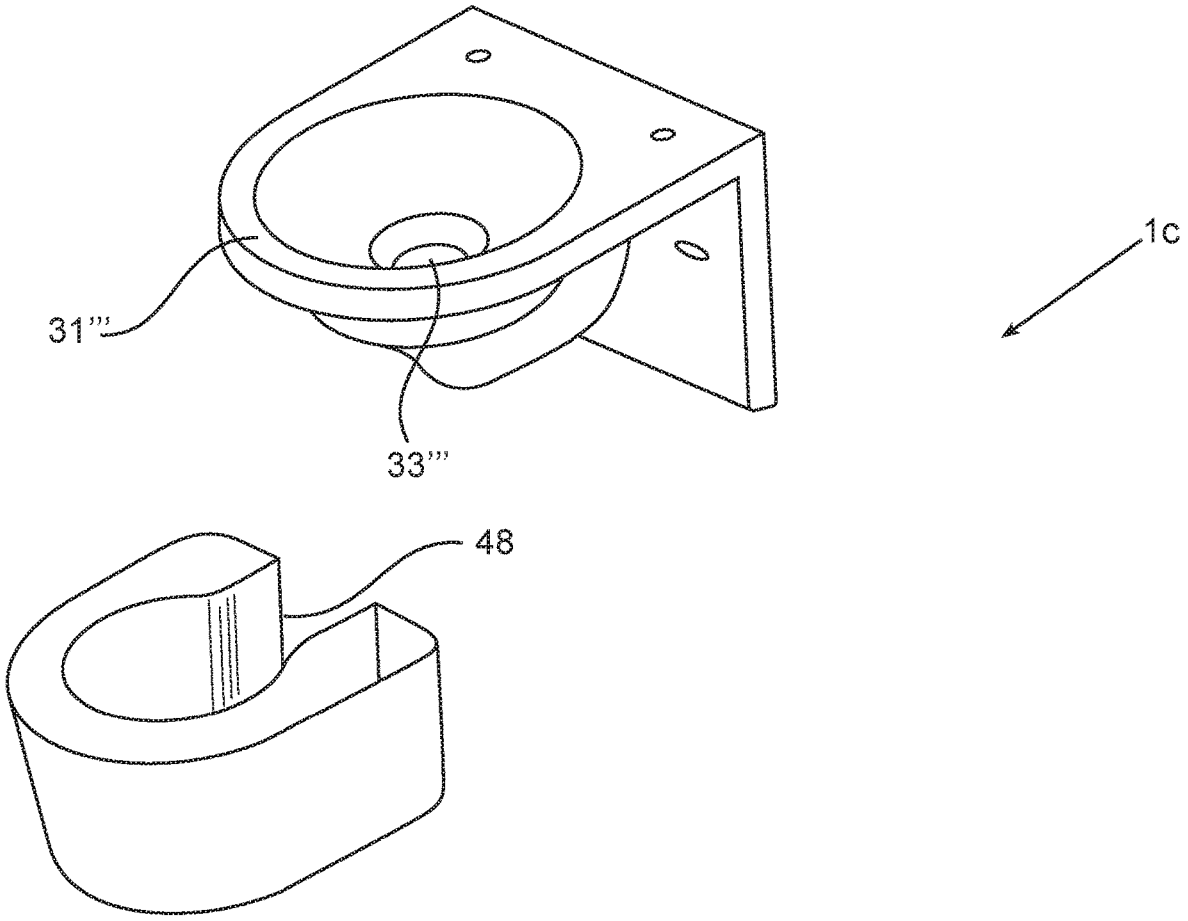

FIG. 3*c* shows an external perspective view of yet another toilet embodiment, which includes a moisture trap.

Figure 3D:
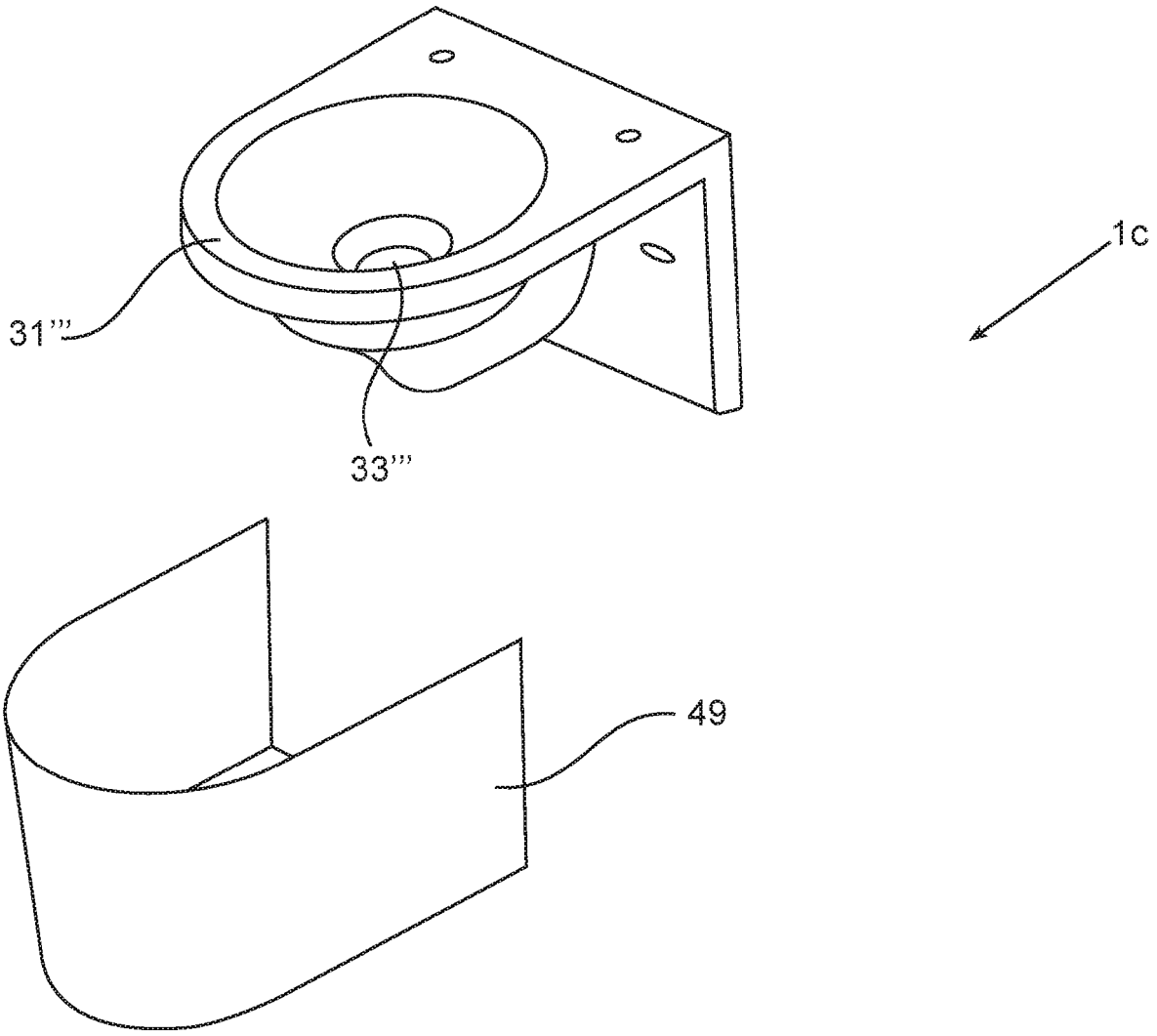

FIG. 3*d* shows an external perspective view of a further toilet embodiment, which includes a cover.

Figure 4A:
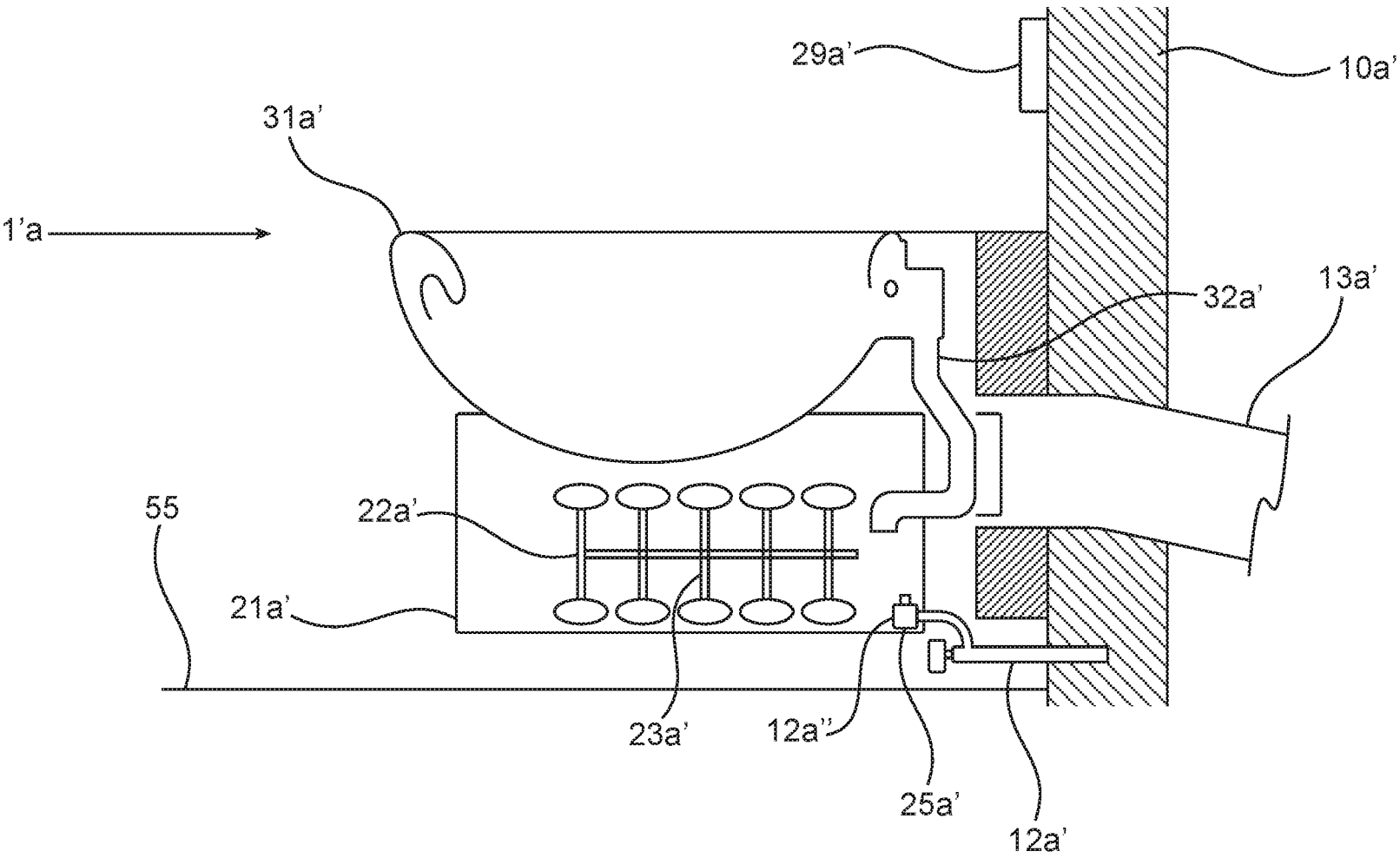

FIG. 4*a* shows a schematic side-view sectional drawing of a toilet embodiment that includes a combined turbine and water pump.

Figure 4B:
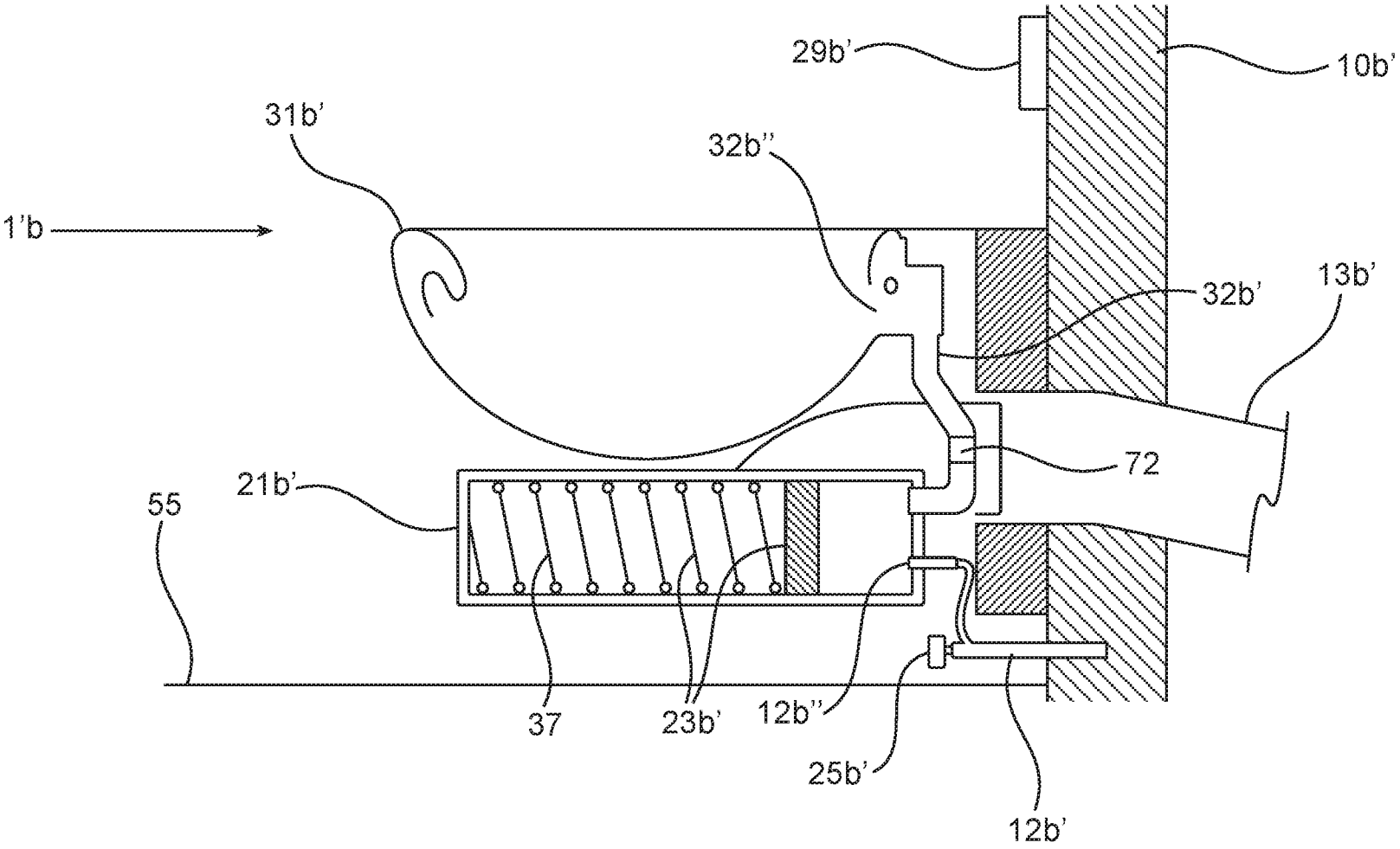

FIG. 4*b* shows a schematic side-view sectional drawing of another embodiment that includes a water pump and no turbine.

Figure 4C:
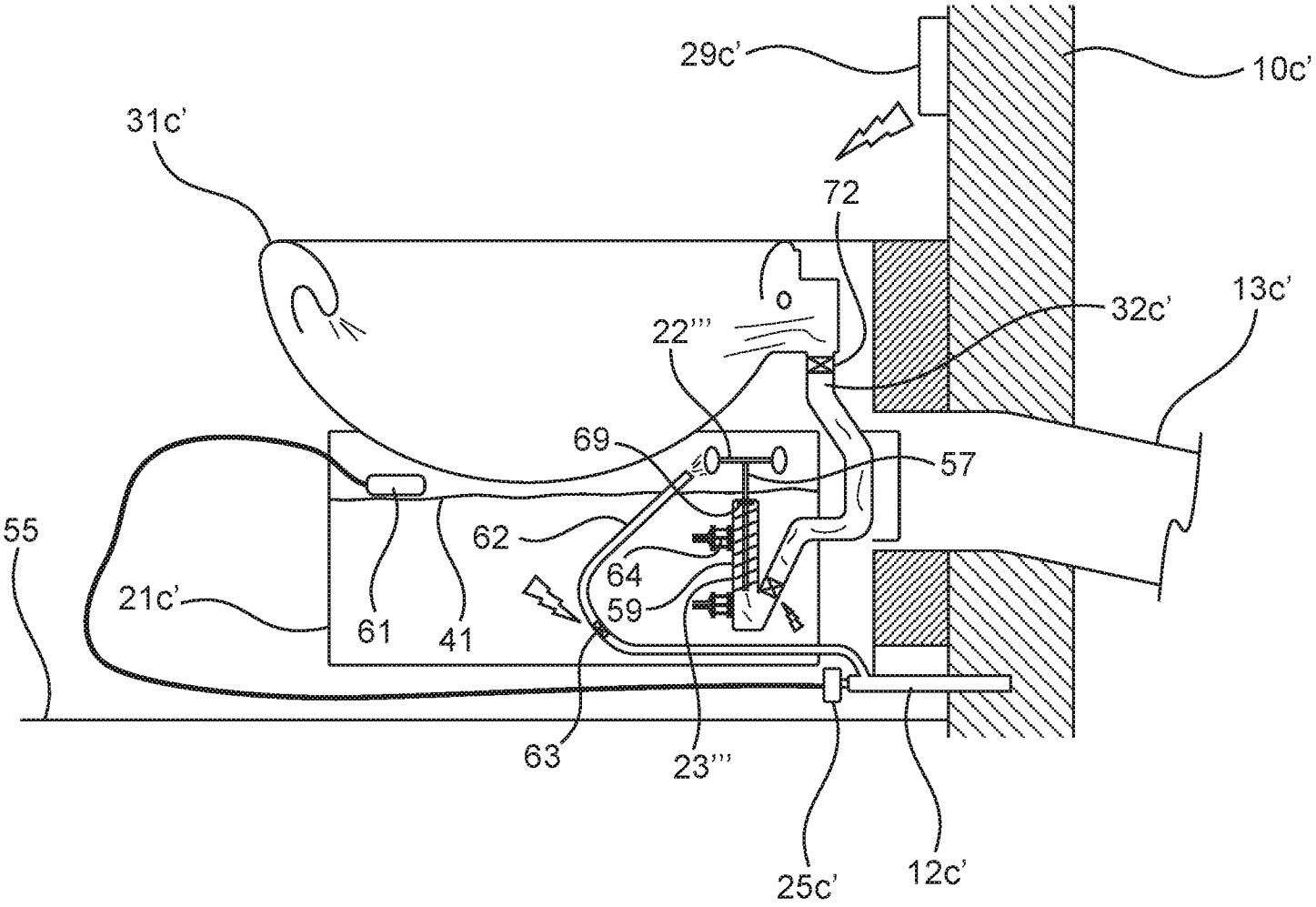

FIG. 4*c* shows a schematic side-view sectional drawing of yet another embodiment that includes a combined turbine and water pump.

DETAILED DESCRIPTION

We have shown in the Background section that connecting standard household water pipes directly to a toilet will generally not provide an adequate flush. However, those same calculations show that if a large portion of the flush water were to be positioned closer to the toilet bowl at the flush time than would be allowed in the scenario in which all the water starts at that time in a the household piping, standard household pressurized water supplies would have more than enough power to push an adequate amount of water in a short enough time into a toilet bowl to produce an adequate flush.

There is a history of using water pressure to create mechanical power. Most people are aware that waterwheels and windmills have been used to drive mills. In addition to that, there were many no-longer well-known water-powered machines that have been replaced by electric power when that became more easily available. There were especially significant improvements in the technology and growth in the usage of the technologies towards the end of the 19th century. Some of the details may be found in this link, <https://www.resilience.org/stories/2013-09-09/power-from-the-tap-water-motors/>: "The smallest water motors were used to run sewing machines, jigsaws, fans, and other similarly mechanized items. The somewhat larger water motors were recommended for operating coffee grinders, ice cream freezers, jeweller's and locksmith's lathes, grindstones, church organs, or drug and paint mills. The largest water motors were used to run elevators or circular saws. In water powered washing machines, the water that was needed to wash the clothes was capable of providing power to the machine simultaneously."

There is an opportunity to provide a toilet to make fuller and better use of the energy that exists in a household pressurised water supplies and to improve use of space in a bathroom by implementing one or more of the following: (1) shortening the distances that flushing water needs to travel, (2) reducing wasted energy, (3) using the greater energy efficiency to improve the flushing action, and (4) using the improved flushing action to avoid the need to have the water tank elevated, and (5) improving the ergonomics of the toilet.

The calculations in the Background section show that if the water to be flushed is brought to within roughly a meter of the toilet bowl, standard household water pressures could provide sufficient power to produce a sufficient standard flush of eight (8) litres in one (1) second.

Referring to FIG. 1, according to one aspect, a flush toilet 1 is provided comprising:

(a) a toilet bowl 31;

(b) a first water conduit 12 comprising a first conduit—first end 14*a* and a first conduit—second end 14*b;*

(c) a second water conduit 32 comprising a second conduit—first end 34*a* and a second conduit—second end 34*b;*

(d) at least one water pump 23, each pump 23 water-powered and not electrically powered, and (e) a water tank 21;

wherein:

(i) the first conduit—first end 14*a* is operationally connectable to an external water pipe 11 comprising pressurized water (not shown);

(ii) the first conduit—second end 14*b* is positioned to allow providing the pressurized water to the water tank 21;

(iii) the second conduit—first end 34*a* is operationally connected to receive water from the water tank 21;

(iv) the second conduit—second end 34*b* is positioned to allow flushing the toilet bowl 31 with the water from the water tank 21;

(v) the at least one water pump 23 are each independently positioned in the water tank and/or in the second water conduit 32;

(vi) the toilet 1 is configured to allow a flush of at least 8 L/second into the bowl 31, and the water tank 21 is positioned proximal to the bowl 31 such that action of water on the at least one pump 23 is necessary to allow the flush of at least 8 L/second. The toilet 1 and components therein are not electrically powered but rather the toilet 1 is entirely powered by water pressure.

The configuration for allowing a flush of at least 8 liters per second includes using components of suitable dimensions and structure to effect such flush as is further discussed below.

The water tank 21 may be positioned in an elevated position, i.e., relative to a floor upon which the bowl 31 rests. The tank 21 is above the bowl 31, to boost the flushing or help bring the flushing power to at least 8 liters per second.

However, in some embodiments the toilet is configured to power the flushing entirely or predominantly from the action of the pressurized water on the water-powered components of the toilet, e.g. water pumps; the tank is placed in proximity to the bowl, for example the tank may rest on the floor, in some embodiments at least partially surround or even partially wrap a bowl's stem 15. Such design may be ergonomic and most economical in terms of compactness of the toilet.

We turn now to FIGS. 1 to 4*c*, showing various embodiments. According to one aspect, a device is provided that is a flush toilet (1, 1*a*, 1*b*, 1*c*, 1*d*, 1'*a*, 1'*b*, 1'*c*). FIG. 1 shows a device with minimal specifics about the components. FIGS. 2*a* through 4*c* show devices with a greater specificity, though in these the focus on the details of the components means that in some of the figures not all components are visible.

The water for the flush is drawn from a water tank (21, 21', 21"21*a*', 21*b*', 21*c*'). The water tank (21, 21', 21", 21*a*', 21*b*', 21*c*') is not necessarily elevated above the toilet bowl (31, 31*a*', 31*b*', 31*c*') and does not rely solely on the potential energy due to the elevation and the consequent pressure created by the elevation to force the flushing water into the toilet bowl (31, 31*a*', 31*b*', 31*c*').

A first conduit is operationally connectable to an external water pipe 11. The operational connection may allow a flush. For example, a flush mechanism 20 may be activated, in some embodiments, by a button (29, 29*a*', 29*b*', 29*c*'). A valve (25, 25', 25", 25*a*', 25*b*', 25*c*') may be provided that opens the first conduit (12, 12', 12", 12*a*, 12*b*, 12*a*', 12*b*', 12*b*", 12*c*', 12*c*") to the external (typically household) water pipes (11). The household water supply is pressurized, so when the first conduit (12, 12', 12", 12*a*, 12*b*, 12*a*', 12*b*', 12*b*", 12*c*', 12*c*") to the toilet (1, 1*a*, 1*b*, 1*c*, 1*d*, 1'*a*, 1'*b*, 1'*c*) is open—that is, not blocked by a closed valve (25, 25', 25", 25*a*', 25*b*', 25*c*')—water is propelled into the tank. Energy from the water flow is harvested by a turbine (22, 22', 22", 22'"), and following acting on the turbine the water goes into the tank (21, 21', 21", 21*a*', 21*b*', 21*c*').

Referring to FIGS. 1, 2*a*, and 2*b*, in some embodiments there is a drivetrain 24 that conveys power from the turbine (22, 22', 22"22'") to the pump (23, 23', 23"23'").

Referring to FIGS. 1, 2*a* and 2*b* as well as 4*a*, 4*b* and 4*c*, the pump (23, 23', 23", 23*a*', 23*b*', 23'") propels water from the tank (21, 21', 21", 21*a*', 21*b*', 21*c*') through the second conduit (32, 32', 32", 32*a*', 32*b*', 32*c*') that empties to the toilet bowl (31, 31'", 31*a*', 31*b*', 31*c*'). The water that is propelled into the tank (21, 21', 21", 21*a*', 21*b*', 21*c*') washes waste materials out of the toilet bowl (31, 31'", 31*a*', 31*b*', 31*c*') through a drainage hole (33, 33'") into the sewage pipes (13, 13*a*', 13*b*', 13*c*').

Advantages

Some toilet embodiments described herein may reduce energy requirements and energy losses in the following manner. The water tank (21, 21', 21", 21*a*', 21*b*', 21*c*') may hold water to be flushed in a position that is not necessarily elevated with respect to the toilet bowl (31, 31'", 31*a*', 31*b*', 31*c*'). Optimal positions for the water tanks (21, 21', 21", 21*a*', 21*b*', 21*c*') in many embodiments may be behind and/or below the toilet bowl (31, 31'", 31*a*', 31*b*', 31*c*'), which in many embodiments is itself close to a wall (10, 10*a*, 10*b*, 10*c*). This placement can make better use of space than conventional toilets with tanks, since the location behind or below the toilet bowl (31, 31'", 31*a*', 31*b*', 31*c*') is usually space for which there is no good use, in contrast to the conventional tank position above the toilet bowl (31, 31'", 31*a*', 31*b*', 31*c*'), which is usually space that could be put to better use.

Technical Problem Overcome

A complication entailed by placing the water tank (21, 21', 21", 21*a*', 21*b*', 21*c*') below or behind the toilet bowl (31, 31'", 31*a*', 31*b*', 31*c*') is that there is no relative elevation to create pressure to power the flush. Some device embodiments (1, 1*a*, 1*b*, 1*c*, 1*d*, 1'*a*, 1'*b*, 1'*c*) use a pump (23, 23', 23", 23*a*', 23*b*', 23'") to increase the flow rate of the water. The device (1) harvests energy from the water pressure in the household water supply (11) to drive the pump (23, 23', 23", 23*a*', 23*b*', 23'"), thereby avoiding the need to connect the toilet (1, 1*a*, 1*b*, 1*c*, 1*d*, 1'*a*, 1'*b*, 1'*c*) to a source of electricity to power an electric pump.

In some embodiments at least one electric pump may be used to boost the flushing power beyond that available from the household water line and action on water-pressure operated pumps, such embodiments may be used for example when the line has low pressure.

In some embodiments having at least one turbine, there is a permeable partition (not shown in any of the figures) between the turbine and the pump to prevent vorticity, turbulence, or other movements of the water in the tank from degrading the performance of the pump by the turbine or of the turbine by the pump. Inclusion of a partition is most likely to be advantageous when the turbine and the pump are both immersed in the water and both churn the water in similar ways.

Positioning of the Water Tank

FIG. 1 shows the water tank 21 positioned between the toilet bowl 31 and the wall 10. FIGS. 4*a*, 4*b*, and 4*c* show the water tank positioned between the toilet bowl and the floor.

The present device could also be positioned above the toilet bowl (not illustrated in a figure). The purpose of this arrangement could be to improve the strength of the flush rather than the avoid having a water tank above the position of the toilet bowl. Even the minimum standard water pressure, 1 atmosphere above the ambient air pressure, can lift water to a height of 10 meters; higher and more typical water pressures are several times that, which would allow the pressure to lift the water to a height of several tens of meters. If a standard toilet with an elevated tank only lifts the water about a meter above the toilet bowl, then 90% or more of the energy from the water pressure is dissipated. The present device is capable of well over 10% energy efficiency, so employing it in an elevated tank has the potential to significantly strengthen the flushing power.

Turbines and Pumps

Some embodiments of the present device use fluid-driven turbines, that is, devices to extract energy from a fluid flow. The choice of which turbine to use can depend on some of the following considerations: the dimensions of the turbine, the directions that fluid enters and exits the turbine, energy efficiency of the turbine, whether the turbine is fully submerged in the water or if it is not fully submerged, and how the harvested power is output from the turbine for delivery to the pump.

Some embodiments comprise at least one water-driven turbine that is not electrically powered.

The toilet may be configured to allow water going through the first conduit to drive the at least one water-driven turbine.

The at least one water-driven turbine may be operationally connected to the at least one water pump so that mechanical power from the at least one water-driven turbine can drive the at least one water pump.

Suitable turbines include impulse turbines and reaction turbines, each of which are categories, and each of which are further divisible. The category impulse turbine comprises Pelton wheels 22" as in FIG. 2*b* and cross-flow turbines. The category reaction turbines comprises propeller turbines such as a Kaplan turbine 22', as in FIG. 2*a*), bulb turbines, straflo turbines, tube turbines, Francis turbines, and kinetic turbines.

Similarly, some embodiments of the present device use pumps, that is, devices that impart momentum and kinetic energy to a fluid. The choice of which pump to use depends on many of the same criteria as for the turbine: the dimensions of the pump, the directions that fluid enters and exits the pump, how power is supplied to the pump, the energy efficiency of the pump, and whether the pump is fully submerged in the water or not fully submerged.

There exist hundreds of types of pumps. The selection can be simplified by grouping the different pumps by category. Pumps can be grouped into positive displacement pumps and rotodynamic pumps. Positive displacement pumps can be reciprocating, such as piston pumps, plunger pumps, and diaphragm pumps; or rotary, such as screw pumps as 23*b*', 23''' in FIGS. 4*b* and 4*c*, gear pumps, and vane pumps such as the impeller pump 23*a*' in FIG. 2*a*). Rotodynamic pumps can be axial (that is, a propeller, as in FIGS. 2*a* and 4*a*), centrifugal, radial, or mixed flow. Each of these categories can be subdivided further.

Transmission of Mechanical Power

There are many ways to transmit the power harvested by the turbine and deliver it to the pump. Some embodiments may include powertrains in a form of intermeshed gears. Some embodiments may use as powertrains wires with torsional rigidity (such as shown in FIGS. 2*a* and 2*b*) or rods/drive shafts with torsional rigidity (such as in FIG. 4*c*). Some embodiments may use chains, inelastic belts, or inelastic wires. Some embodiments may use combinations of one or more of each of these.

In some embodiments a train defines an operational connection from the at least one fluid-driven turbine to the at least one pump, and the powertrain comprises a plurality of interconnected items selected from the following list:

(a) gears, (b) wires with torsional rigidity, (c) rods with torsional rigidity, (d) chains, (e) inelastic belts, and inelastic wires.

The power-conveying mechanical connections ("powertrain") from the fluid-driven turbine (22, 22', 22", 22''') to the pump (23, 23', 23", 23*a*', 23*b*', 23''') that gives water the momentum to flush -may comprise interconnected gears, wires with torsional rigidity (such as in FIGS. 1, 2*a*, and 2*b*) and/or rods/drive shafts with torsional rigidity (such as in FIGS. 4*a* and 4*c*), and/or chains or belts. FIGS. 1, 2*a*, and 2*b* show the powertrain (24, 24', 24") as comprising a wire with high torsional stability. FIGS. 4*a* and 4*c* show the powertrain as being a rigid rod with high torsional stability. Embodiments of the powertrain comprising interlocking gears, chains, or belts are not illustrated by figures.

In some embodiments of the device, the fluid-driven turbine may be a Kaplan turbine. This is the turbine (22') shown in the embodiment in FIG. 2*a*. When the valve (25') is open, water passes through the first conduit (12') and where the water must pass through the Kaplan turbine (22'), it gives up some of its momentum and that gives torque to the turbine (22'). The water continues past the turbine end empties from the second end of the first conduit (12') into the water tank (21').

In the embodiment depicted in FIG. 2*a*, power is delivered from the Kaplan turbine (22') to the pump (23') via a powertrain (24'), which in this embodiment is a wire with torsional rigidity, which couples the Kaplan turbine (22') (attached to the powertrain 24' along the axis (22*x*') thereof) to the pump (23') (attached to the powertrain 24' along the axis (23*x*') thereof) that gives the water the momentum to flush.

In the embodiment 1' shown in FIG. 2*a*, the type of pump (23') is an impeller. The impeller (23') is connected at its axle (23*x*') to the torsionally rigid wire (24'), so that torque, and thus power, is transmitted from the Kaplan turbine (22') to the impeller-type pump (23'). When the pump (23') is being powered, water is pushed through the second conduit (32') from the tank (21') into the toilet bowl (not shown in this figure).

In some embodiments of the device, the fluid-driven turbine may be a Peloton wheel <https://en.wikipedia.org/wiki/Pelton_wheel>. This is the turbine 22" shown in the embodiment in FIG. 2*b*. When the valve (25") is opened, water passes through the first conduit (12") and comes out in a squirt (42) directed at the impulse blades (26) of the Peloton wheel (22"). The force of the squirting water (42) puts torque on the Peloton wheel (22") and leaves the water with less momentum so that the water falls downward (43), from where the water is poised to be flushed by the pump (23") into the toilet bowl (not included in this figure). The Peloton wheel (22") produces its power at its axle (22*x*"). The axle (22*x*") is above the water level (41") in the tank (21").

In the embodiment illustrated in FIG. 2*b*, power is delivered from the Peloton wheel (22") to the pump (23") via a powertrain (24"), which in this embodiment is a wire with torsional rigidity coupling the axis (22*x*") of the turbine (22") to the axis (23*x*") of the pump (23") that gives the water the momentum to flush.

In the embodiment 1" shown in FIG. 2*b*, the pump (23") is a propeller, that is, an axial rotodynamic pump. Torque, and thus power, is transmitted from the turbine (22") to the pump (23"). When the pump (23") is being powered, water is pushed through the second conduit (32") from the tank (21") into the toilet bowl (not shown in this figure).

FIG. 1, 2*a* shows an embodiment 1, 1' respectively in which the water tank is between the toilet bowl and the wall 10. FIGS. 4*a*, 4*b*, and 4*c* show embodiments in which the water tank is between the toilet bowl 31*a*', 31*b*', 31*c*' respectively and the floor 55.

FIGS. 3*a*, 3*b* show external perspective views of embodiments 1*a*, 1*b* respectively comprising cartridges (35*a*, 35*b*) respectively, which are positioned within a toilet bowl (not shown). The water conduits (12*a*, 32*a*, 12*b*, 32*b*) into and out of the cartridges (35*a*, 35*b*) in FIGS. 3*a* and 3*b* go in different directions, to match different household plumbing arrangements or different types and configurations of turbines and pumps inside the cartridges (35*a*, 35*b*).

FIG. 4*a* highly schematically shows an embodiment of the device (1'*a*) in a side-sectional view with some components removed for ease of view. The toilet 1'*a* includes a water tank (21*a*') situated below a toilet bowl (31*a*'), i.e., between the bowl 31*a*' and a floor 55 upon which the bowl 31*a*' stands. Water (not shown) enters the first conduit (12*a*') from the household pipes (not shown). If the valve (25*a*'), which is controlled by a button (29*a*'), is open, water flows through the continuation of the first conduit (12*a*") and goes toward the turbine 22*a*' and drives the turbine 22*a*'. The turbine 22*a*' is mechanically directly connected to the pump (23*a*') and may actually be one component. The pump (23*a*'), which is a propeller, when powered, drives water through the second conduit (32*a*') into the toilet bowl (31*a*') to create the flush. The flushing water together with waste products exits to the sewage through sewage pipes (13*a*').

FIG. 4*b* shows another device embodiment 1'*b* designed to include components below the toilet bowl 31*b*' and above the floor 55. Water enters the first conduit (12*b*') from the household pipes (not shown). If the valve (25*b*'), which is controlled by a button (29*b*'), is open, water flows through the continuation of the first conduit (12*b*") and goes toward the pump (23*a*'). The pump 23*b*' is essentially a piston with a strong spring 37. The pump 23*b*', when primed and subsequently released by opening a valve 72 in the second conduit 32*b*', drives water through the second conduit (32*b*') into the opening (32*b*") of the toilet bowl (31*a*') to create the flush. The flushing water together with waste products exits to the sewage through sewage pipes (13*b*').

Note that this pump 23*b*' may be primed by feeding water therein before the flushing time, so that at the time of flushing the pump 23*b*' holds under pressure water for flushing.

In some embodiments while the pump 23*b*' is being emptied water is prevented from entering the pump 23*b*' by closing the valve 25*b*', to prevent back-pressure on the pump 23*b*'. The valve 25*b*' may be a normally open (NO) valve.

After the pump is emptied the pump 23*b*' can be refilled. In some embodiments, while refilling, the normally closed (NC) valve 72 in the second conduit 32*b*' is closed so as to allow resumption of build up of pressure in the pump 23*b*'.

In other embodiments, the valve 72 may remain open for a while to allow a continued, weaker flush for a while. The weaker flush in some embodiments can be controlled to be prolonged or shortened and in some embodiments has a default duration after which the valve 72 may be automatically closed. In some embodiments the flush can be in pulses: the initial flush is followed by a refill of the pump 23*b*'; upon full refill of the pump 23*b*' another at least one flush can be made, either automatically or by command of a user via button 29*b*' or another control device operationally coupling a control widget to the valve 72.

The spring 37 is preferably made of an elastomer since metallic springs tend to corrode.

Note that the device 1'*b* is a relatively simple embodiment and doesn't include a turbine. The device also has an advantage that the pump 23*b*' can be pressurized at the instant of commanding a flush, rather than a turbine boosting the pump at the instant of commanding.

Experiments on the cartridge 35*c* demonstrated a very powerful flush. Two of the cartridges working in unison would be more than sufficient to effectively flush a toilet.

At present I believe that this embodiment operates best, but the other embodiments are also satisfactory.

FIG. 4*c* shows another embodiment 1*c*' with a water tank 21'*c* between the toilet bowl 31'*c* and the floor 55. This figure shows a snapshot of the start of a flushing of the toilet 1*c*'. The toilet 1*c*' includes a combined turbine 22''' and screw pump 23''' having a shared drive shaft 57. The pump 23''' comprises a housing 59, through which part of the shaft 57 extends.

Water enters the first conduit (12*c*') from the household pipes (not shown) and flows onto the turbine 22''' to turn thereof and consequently employ the pump 23''' to provide the toilet bowl 31'c with a flush.

The main valve (25*c*') on first conduit 12*c*' is controlled by float 61. When the level 41 of the water in the tank 21*c*' reaches the float 61 then the main valve 25'*c* closes. Keeping the level 41 of the water below the float 61 serves to keep the turbine 22''' above the level of the water in the tank 21*c*' and thus reduce loss of turbine kinetic energy due to contact with the water in the tank 21'*c*.

The first conduit 12' comprises a flush conduit 62 equipped with a normally closed (NC) flush valve 63.

When the manual flush button 29*c*' is pressed, the flush valve 63 is opened, allowing water to reach the turbine 22". Movement of the turbine 22" is effected, causing the drive shaft 57 to rotate. As the drive shaft 57 rotates water is pushed by the screw pump 23''' forwards in the housing 59, displacing water out of the housing 59 and into the bowl 31*c'*.

Water continues to impinge upon the turbine 22''' during the flush, and thus the capacity of the toilet 1*c*' may be larger than the capacity of the toilet 1'*b* illustrated in FIG. 4*b*.

When the flushing stage ends, according to an arrangement such as time passing after the pressing of the manual flush button 29*c*', the flush valve 63 may be closed. At this point the pump 23''' may be at least partially depleted and needs to be refilled.

The flush conduit 62 is carefully positioned relative to the turbine 22''' so that:

a) A stream of water hits the turbine 22''';

b) The turbine 22''' doesn't hit the conduit 62 while revolving;

c) The movement of the turbine 22''' is in a desired direction. The shaft 57 and pump housing 59 in the figure are configured to allow flushing to occur by clockwise rotation of the turbine 22", as seen when viewing the turbine 22''' from a view distal to the pump 23'''. Therefore, if the turbine 22''' is flush with the page then the flush conduit would be positioned in front of the page.

To be most effective, the pump housing 59 can be designed so that water can only enter therein, not leave thereout, so that during the flushing stage no water (and kinetic energy) is lost to the water tank 21*c*'. For this purpose, check valves 67 can be embedded in the housing 59 such as to allow water to enter the housing 59 but not leave the housing 59. The shaft 57 is sealed within the housing 59; that is, entrance of water into the housing is prevented or reduced by sealing around the shaft 57, for example with an o-ring 69. In other embodiments there are no check valves and water can freely enter the housing 59 to replace flushed water. Some water may be lost from the pump 23'''; however a suitable design of the pump 23''' may minimize this loss and reduce it to a relatively small amount.

The refilling can continue until the pump 23''' is entirely refilled or until the water tank 21*c*' is refilled and the float 61 stops the refilling.

At times, the evacuation of waste from the bowl 31*c*' may be delayed, or the bowl can become clogged, for example by a problem of the sewage system to which the toilet 1*c*' is coupled. Therefore, valves 72, optionally one or more being check valves, can be placed in the second conduit 32*c*' to prevent waste from reaching the pump 23'''.

Each toilet 21*c*' may comprise at least one turbine 22''' and at least one pump 23''' on each side of the bowl. The turbines 22''' and pumps 23''' may share one water tank 21*c*' or in other embodiments each side may have a separate water tank 21*c*'. Typically, the total volume of the housings 59 is at least 6 liters. The content typically can be delivered to the bowl 31'*c* within 1 second of pressing the flush button 29*c*'. The pressure of the incoming water, the design of the pumps, their size etc. may be adjusted to achieve the minimum flush rate of 6 liters per second or more or to reduce the flush rate to prolong the life of the components. In some embodiments the toilet includes two pumps and two turbines sharing a water tank.

In some embodiments including multiple pumps/turbines (not shown), they share at least some piping. For example, the second conduit 32*c*' may be shared by the pumps. In such embodiments cost of the toilet is minimized and a flush initiation will provide a swift and strong flush. In other embodiments the piping is not shared (of the first and second conduit) and a partial flush may be feasible, allowing saving flushing water by performing a smaller flush. Such embodiments will also allow making a small flush while one of the pumps is undergoing maintenance or is malfunctioning.

The float 61 as shown in the figure controls main valve 25*c*' via a wire. In other embodiments the control is remote e.g., via an electromagnetic signal. In other embodiments the control is mechanical, similar to many commercially available toilets. In yet other embodiments the control is electromechanical.

The valves 63 and 72 in the flush conduit 62 and the second conduit 32*c*', respectively, as shown in the figure are activated and deactivated by electromagnetic pulses, the flushes being started by a user pushing the button 29*c*'. In other embodiments the valves are mechanically or electromechanically activated.

Referring back to FIG. 3*c*, the toilet embodiment 1*c* is shown in perspective view. The FIG. 3*c* shows a toilet bowl 31''' and moisture trap 48. Other components are removed for the sake of clarity of view. The trap 48 is shaped to wrap around at least a part of the bowl 31''', as shown the trap 21*c* is U—trough-shaped. The trough shape and size of the trap 48 is designed to contain the water tank, pump, second conduit and optionally the first conduit and turbine hidden from view. The trap 48 can also serve to collect small amounts of water that may drip from the parts, for example from condensation or small leak, rather than drip on the floor. The U-shape allows positioning the trap 48 flush with the bowl 31''' for optimal compactness of the toilet 1*c*.

FIG. 3*d* illustrates parts of a toilet embodiment 1d in perspective view. A cover 49 may be used to keep hidden from view components such as the water tank and conduits (not shown). The cover 49 may also serve to collect materials such as condensation from reaching the floor. The cover 49 as shown has a bottom 27. The cover 21*d* may be sized to hold a trap such as the one 21*c* shown in FIG. 3*c*.

In some embodiments one or more of the at least one pump is electrical and the at least one turbine are all water powered.

Clarifications About Terminology

In the discussion, unless otherwise stated, adjectives such as "substantially" and "about" that modify a condition or relationship characteristic of a feature or features of an embodiment of the invention, are to be understood to mean that the condition or characteristic is defined to within tolerances that are acceptable for operation of the embodiment for an application for which it is intended.

It should be noted that the term "item" as used herein refers to any physically tangible, individually distinguishable unit of packaged or unpackaged good or goods. Positional terms such as "upper", "lower" "right", "left", "bottom", "below", "lowered", "low", "top", "above", "elevated", "high", "vertical" and "horizontal" as well as grammatical variations thereof as may be used herein do not necessarily indicate that, for example, a "bottom" component is below a "top" component, or that a component that is "below" is indeed "below" another component or that a component that is "above" is indeed "above" another component as such directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

"Coupled with" means indirectly or directly "coupled with".

It is important to note that the methods described above are not limited to the corresponding descriptions. For example, the method may include additional or even fewer processes or operations in comparison to what is described herein and/or the accompanying figures. In addition, embodiments of the method are not necessarily limited to the chronological order as illustrated and described herein.

It should be understood that where the claims or specification refer to "a" or "an" element or feature, such reference is not to be construed as there being only one of that element. Hence, reference to "an element" or "at least one element" for instance, may also encompass "one or more elements".

Unless otherwise stated, the use of the expression "and/or" between the last two members of a list of options for selection indicates that a selection of one or more of the listed options is appropriate and may be made.

It is noted that the term "perspective view" as used herein may also refer to an "isometric view" and vice versa.

It should be appreciated that certain features which are, for clarity, described in the context of separate embodiments, may also be provided in combination in a single embodiment. Conversely, various features, which are, for brevity, described in the context of a single embodiment, example and/or option, may also be provided separately or in any suitable sub-combination or as suitable in any other described embodiment. Certain features described in the context of various embodiments are not to be considered essential features of those embodiments, unless the embodiment, example, and/or option are inoperative without those elements. Accordingly, features, structures, characteristics, stages, methods, modules, elements, entities or systems disclosed herein, which are, for clarity, described in the context of separate examples, may also be provided in combination in a single example. Conversely, various features, structures, characteristics, stages, methods, modules, elements, entities or systems disclosed herein, which are, for brevity, described in the context of a single example, may also be provided separately or in any suitable sub-combination.

It is noted that the term "exemplary" is used herein to refer to examples of embodiments and/or implementations, and is not meant to necessarily convey a more desirable use-case.

In alternative and/or other embodiments, additional, fewer, and/or different elements may be used.

Throughout this description, various embodiments may be presented in a range format. It should be understood that the description in range format is merely for convenience and brevity and should not be construed as an inflexible limitation on the scope of the embodiments. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include—where applicable—any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

While the aspects have been described with respect to a limited number of embodiments, these should not be construed as scope limitations, but rather as exemplifications of some of the embodiments.

I claim:

1. A device comprising: a pressurized input water source with a valve; water tank; and a flush toilet resting over a floor, the flush toilet comprising:

(a) a toilet bowl;

(b) a first water conduit comprising a first conduit—first end and a first conduit—second end;

(c) a second water conduit, comprising a second conduit—first end and a second conduit—second end, and;

(d) at least one water pump, the at least one pump water-powered and not electrically powered; wherein:

(i) the first conduit—first end is operationally connectable to the pressurized input water source;

(ii) the first conduit is positioned to allow providing the pressurized water for instant action on the water pump;

(iii) the second conduit—first end is operationally connected to receive water from the water pump;

wherein the water tank is not elevated above the toilet bowl, and the water pump is positioned proximal to the bowl and between the bowl and the floor, and wherein the toilet is configured such that when the valve from the pressurized input water source is opened, water is propelled from the water tank to the toilet bowel by the at least one pump, and instant action of the pressurized water on the at least one pump allows a flush of at least 6 liters per second.

2. The device of claim 1, further comprising at least one water-driven turbine not electrically powered; the toilet configured to allow water going through the first conduit to drive the at least one water-driven turbine, the at least one water-driven turbine operationally connected to the at least one water pump so that mechanical power from the at least one water-driven turbine can drive the at least one water pump.

3. The device of claim 2, wherein the at least one water-driven turbine is each independently selected from the following list: an impulse turbine, and a reaction turbine.

4. The device of claim 1, wherein the at least one water pump is each independently chosen from the following list: a positive displacement pump, a reciprocating pump, a rotary pump, a rotodynamic pump, a centrifugal pump, a mixed flow pump, and a radial pump.

5. The device of claim 2, wherein a powertrain defines an operational connection from the at least one fluid-driven turbine to the at least one pump, and wherein the powertrain comprises a plurality of interconnected items selected from the following list:

(f) gears, (g) wires with torsional rigidity, (h) rods with torsional rigidity, (i) chains, (j) inelastic belts, and (k) inelastic wires.

6. The device of claim 1, wherein action of water on the at least one pump allows the flush of at least 8 liters per second.

7. The device of claim 2, wherein the at least one turbine and the at least one pump are both immersed in water and both churn the water.

8. The device of claim 2, comprising units each including a turbine of the at least one turbine and a pump of the at least one pump.

9. The device of claim 1, wherein the at least one pump is primable by feeding water therein before the flushing time.

10. The device of claim 1, further comprising a first valve, wherein while the pump is being emptied water is prevented from entering the pump by closing the first valve, thereby preventing back-pressure on the pump.

11. The device of claim 1, wherein the second conduit comprises a second valve, the toilet configured to allow while refilling the at least one pump, the second to be closed so as to allow resumption of build up of pressure in the at least one pump.

12. The device of claim 1, wherein the second conduit comprises a second valve, the toilet configured to allow while refilling the at least one pump, the NC valve to remain open to allow a continued, weaker flush.

13. The device of claim 12, further configured to allow controlling the weaker flush to be prolonged or shortened.

14. The device of claim 2, the first conduit comprising a float and a main valve controlled by the float, the toilet configured to allow the main valve to close when a water level in the tank reaches the float, thereby keeping the at least one turbine above the level of the water in the tank.

15. The device of claim 1, the second conduit comprising one or more check valves capable of preventing waste from reaching the at least one pump.

16. The device of claim 1, further comprising a moisture trap.

17. The device of claim 1 wherein the first conduit—second end provides the pressurized water to a turbine connected directly to the water pump, and the turbine drives the pump to propel water from the water tank at an instant of commanding a flush by opening the valve from the input water source.

* * * * *